US007796919B2

(12) United States Patent
Murakami et al.

(10) Patent No.: US 7,796,919 B2
(45) Date of Patent: Sep. 14, 2010

(54) IMAGE FORMING APPARATUS CAPABLE OF PREVENTING WORSENING OF IMAGE QUALITY CAUSED BY EXCESSIVELY CHARGED DEVELOPER

(75) Inventors: Susumu Murakami, Kyoto (JP); Yoshiaki Kojoh, Nara (JP); Takahisa Narikiyo, Nara (JP); Kuniaki Nakano, Kyoto (JP); Yoshie Iwakura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 982 days.

(21) Appl. No.: 10/557,182

(22) PCT Filed: May 17, 2004

(86) PCT No.: PCT/JP2004/007010

§ 371 (c)(1),
(2), (4) Date: Nov. 17, 2005

(87) PCT Pub. No.: WO2004/102281

PCT Pub. Date: Nov. 25, 2004

(65) Prior Publication Data

US 2006/0256399 A1 Nov. 16, 2006

(30) Foreign Application Priority Data

May 19, 2003 (JP) ..... 2003-140664

(51) Int. Cl.
*G03G 21/00* (2006.01)

(52) U.S. Cl. ..... 399/129

(58) Field of Classification Search ..... 399/55, 399/129, 270, 156, 145, 149, 150, 252, 264
See application file for complete search history.

(56) References Cited

FOREIGN PATENT DOCUMENTS

| | | | |
|---|---|---|---|
| JP | 10-133531 | A | 5/1998 |
| JP | 11-194556 | A | 7/1999 |
| JP | 2000-214663 | A | 8/2000 |
| JP | 2001-134144 | A | 5/2001 |
| JP | 2001-324843 | A | 11/2001 |
| JP | 2002-14591 | A | 1/2002 |
| JP | 2002-23576 | A | 1/2002 |
| JP | 2002-49184 | A | 2/2002 |
| JP | 2002-202667 | A | 7/2002 |
| JP | 2003-307887 | A | 10/2003 |

OTHER PUBLICATIONS

Machine translation of JP 10133531 A.*
Machine translation of JP 11194556 A.*
Machine translation of JP 2000214663 A.*

* cited by examiner

*Primary Examiner*—David M Gray
*Assistant Examiner*—Billy J Lactaoen
(74) *Attorney, Agent, or Firm*—Birch, Stewart, Kolasch & Birch, LLP

(57) ABSTRACT

For an electrostatic latent image formed on an image carrier (31*b*), besides an operation forming an "image forming electrostatic latent image" used to form the primary image, an operation is executed that forms an "electrostatic latent image for removing developer" for removing developer that resides on a developer supply member (53*a*) for a predetermined time period onto the image carrier (31*b*). Thus, developer is nearly eliminated from residing on this developer supply member (53*a*) in an overcharged state for a long period of time, and generation of a fogged image is avoided as much as possible.

16 Claims, 8 Drawing Sheets

IMAGE FORMING APPARATUS CAPABLE OF PREVENTING WORSENING OF IMAGE QUALITY CAUSED BY EXCESSIVELY CHARGED DEVELOPER

BACKGROUND OF THE INVENTION

1. Field Of The Invention

The present invention relates to an image forming apparatus, of which digital copy machines, laser printers, laser facsimiles and the like are representative. Specifically, the present invention relates to a measure for preventing the worsening of image quality caused by excessively charged developer (overcharged toner) that resides on a development sleeve (developer supply member) of a development apparatus.

2. Description Of The Related Art

Conventionally, as an image forming (printing) operation in an electrophotographic image forming apparatus such as a laser printer, an electrostatic latent image is formed on a photosensitive drum based on image data sent from a host apparatus such as a personal computer, toner (developer) is affixed to this electrostatic latent image, and image data is made as a development on the photosensitive drum. Afterwards, recording paper transported on a paper transport path is passed between the photosensitive drum and a transfer roller, and the toner image on the photosensitive drum is transferred to the front side of the recording paper. Then, this recording paper passes a fixing roller, and the toner image is fixed onto the recording paper with heat and pressure by the fixing roller.

As a configuration of the development apparatus in which image data is made as a development on the photosensitive drum, a development tank filled with toner and a development roller that supplies this toner to the photosensitive drum are provided. The surface portion of this development roller is made of metal and configured of a development sleeve that has been charged to a predetermined electric potential. As a developing operation by this development apparatus, the toner inside the development tank is carried on the surface of the development sleeve, and the toner is carried by the rotation of the development roller to a development region facing the photosensitive drum. In this development region, the toner on the surface of the development sleeve is adsorbed on the electrostatic latent image on the photosensitive drum, making this electrostatic latent image visible.

In recent years, the development of image forming apparatuses of this type provided with a double-sided printing function that performs printing on both the front side and the back side of the recording paper has been advancing. As a method for this double-sided printing, ordinarily printing is performed one sheet at a time with front and back print data. That is, a main transport path and a reverse transport path are provided as the transport path that transports the recording paper, and a switchback mechanism for performing switchback transport of the recording paper is also provided. After transporting the recording paper in the main transport path and performing front side printing, that recording paper is transported into the reverse transport path via the switchback mechanism, thus reversing the front and back of the recording paper. It is again transported into the main transport path, and printing is performed on the back side of the recording paper.

When performing double-sided printing with this type of image forming apparatus, as described above, after transferring a toner image to one side of one sheet of recording paper, a fixing process is performed that fixes the toner image to that recording paper, and afterwards, back side printing subsequently begins. Because heat fixing is generally performed in the fixing process, the moisture content of the surface of the recording paper used in this fixing process is reduced by the fixing heat. As a result, the surface resistance value of the recording paper when performing back side printing is increased in comparison to the surface resistance value of the recording paper when performing front side printing.

Ordinarily, a constant current control is performed in the transfer process that controls the transfer operation with a constant electric current, but as described above, when performing transfer for double-sided printing, when executing a transfer operation with a constant current control to identical paper of a different surface resistance value, the transfer voltage applied to the transfer roller when performing the transfer process is vastly different for front side printing and back side printing. The surface resistance value of the paper (ordinarily, about $1\times10^{6}$ to $1\times10^{10}\Omega\cdot$cm) changes about $1\times10^{1}$ to $1\times10^{2}\Omega\cdot$cm depending on the type and the size of the paper, the moisture content of the paper, the surrounding environment, and the like, and due to the large change in the surface resistance value of the paper that accompanies the fixing process as described above, the transfer voltage when printing the back side may be an applied voltage nearly two times the transfer voltage when printing the front side.

When performing double-sided printing for multiple sheets of paper in such conditions, when printing the second and subsequent sheets, print defects are generated due to "fog", which is described below. Following is an explanation of the circumstances in which this "fog" is generated.

FIG. 7(*a*) is a drawing that illustrates the change in the electric current of the transfer roller and the surface electric potential of the photosensitive drum in the transfer process of a conventional example. FIG. 7(*a*) shows the positional relationship between the transfer roller and the photosensitive drum. FIG. 7(*b*) shows the relationship between position and electric current in the transfer roller in this conventional transfer process. FIG. 7(*c*) shows the relationship between the position of the photosensitive drum and the surface electric potential of the photosensitive body in this conventional transfer process.

As shown in FIG. 7(*a*) through (*c*), the paper is sandwiched between a transfer roller 101 and a photosensitive body 102, and when transferring the toner image of the photosensitive body 102 to the paper, the transfer current i1*a* (electric current of the transfer roller) that flows in the direction of the photosensitive body in the transfer process for the front side of the first sheet of paper is about constant.

Thus, the surface electric potential v1 of the photosensitive body 102 after the transfer process for the front side of the first sheet of paper has been performed (immediately before performing the transfer process for the back side of the first sheet of paper) is approximately constant across the entire photosensitive body 102.

However, when performing the transfer process for the back side of the first sheet of paper, because the paper has been through the fixing process when printing the front side, as described above, the resistance value of the paper has increased, and because of that increase in the resistance value the transfer current cannot easily flow. As a method for eliminating such a problem, the constant current control system described above that always lets a constant current flow is adopted. This method attempts to maintain a constant current by increasing the voltage by the extent that it is difficult for the current to flow.

On the other hand, outside the region where paper is arranged (a portion separate from the paper passage region), paper does not lie between the photosensitive body 102 and the transfer roller 101, current flows easily because resistance is the same as under the condition when performing the transfer process for the front side of the first sheet, and in comparison to when performing the transfer process for the front side of the first sheet, a large amount of transfer current i1*b* flows on the photosensitive body 102 outside of the region where paper is arranged. Outside the region that paper is arranged, the voltage at this time is the same as for the region where paper is arranged (paper passage region), and is a higher voltage than when performing the transfer process to the front side of the first sheet.

Due to this phenomenon, on the photosensitive body 102 outside the region where the paper is arranged, a large amount of transfer current of a polarity opposite to the charging polarity of the photosensitive body flows at a high voltage (if this continues for a long time, it is possible that the photosensitive body will be damaged), and as a result the charging potential of the photosensitive body 102 decreases (a balancing phenomenon due to reverse potential occurs).

Thus, in the photosensitive body 102 after performing the transfer process for the back side of the first sheet of paper (immediately before performing transfer for the front side of the second sheet of paper), the surface electric potential v2 of both edges that are outside the region where the paper is arranged decreases.

On the other hand, on the development sleeve in the development apparatus, the toner affixed to the region corresponding to the paper size, that is, corresponding to the region where the paper is arranged, is taken (supplied to the photosensitive body) as necessary during the image forming operation. However, for toner affixed in the region corresponding to the region where paper is not arranged, which is the region outside the paper size, a state is constantly maintained wherein the toner is kept on the development sleeve, frictional charging due to friction with the photosensitive body 102, friction with a toner layer thickness regulating member (doctor blade), and the like is repeated, and the charging potential rises too much. That is, overcharged toner is always affixed on both sides in the axial direction (the region corresponding to the region where paper is not arranged).

FIG. 8 shows how toner t1 and t2 is affixed on the development sleeve 103. The density of the toner t1 and t2 in FIG. 8 indicates the charging quantity. Within a developer rising region R100 of the development sleeve 103, a central portion R101 not including the both side portions R102 in the axial direction corresponds to the image region. In this central portion R101, because an electrostatic latent image is formed on the photosensitive body 102 during the image forming operation and the toner t1 is stripped away, the toner t1 is periodically replaced (metabolized in the developing process), the charging quantity of the toner t1 does not increase too much. On the other hand, in both side portions R102 in the axial direction of the development sleeve 103, no electrostatic latent image is formed on the photosensitive body 102, and the toner t2 is not stripped away. Thus, rotation on the development sleeve 103 continues without the toner t2 being replaced, and the charging quantity is increased too much due to members that rub against the development sleeve 103. The toner t2 in this state is referred to as "overcharged toner". This toner t2 is also referred to as "dead developer (dead toner)", meaning that it does not contribute to image forming (is not consumed), and both side portions R102 of the development sleeve 103 are referred to as "dead developer generating regions", meaning that this sort of dead developer is generated.

FIG. 9 shows the change in the charge amount of the toner t1 and t2 on the development sleeve 103. As seen from this diagram, the toner t1 in the central portion R101 of the development sleeve 103 contributes to development (is consumed), and its charging quantity c1 does not rise excessively. On the other hand, because the toner t2 in both side portions R102 of the development sleeve 103 does not contribute to development (is not consumed), its charging quantity c2 rises excessively, and becomes so-called "dead toner".

In theory, the initial charging polarity and electric potential of the photosensitive body 102 are set assuming that all of the toner on the development sleeve 103 is charged to an appropriate level, and toner does not affix to the region outside of the electrostatic latent image. However, due to a decrease in the surface electric potential in the vicinity of both edges which are outside the paper arranging region of the photosensitive body 102 as described above, and overcharged toner affixing in both side portions R102 of the development sleeve 103, the phenomenon occurs that overcharged toner affixes unintentionally on the photosensitive body 102 outside the paper arranging region.

In this way, a state in which overcharged toner is affixed to the photosensitive body 102 continues until the photosensitive body completes at least one full turn (until the overcharged toner passes the cleaning apparatus and is eliminated). In such a state in which overcharged toner is affixed, when the second page of paper is transported onto the photosensitive body 102, if a shift of that paper transport position occurs in the axial direction of the photosensitive body (displacement in the width direction of the paper), an image fogged by overcharged toner is transferred onto this paper due to one edge of the paper making contact with the region where overcharged toner is affixed, and image quality deteriorates.

This sort of phenomenon is not limited to the case in which displacement of the paper transport position occurs; it may also occur under a condition in which an image forming operation is performed for paper (B5-size paper, for example) that has a comparatively short width dimension (dimension in the direction perpendicular to the paper transport direction) and overcharged toner affixes to the region outside this paper size, and when an image forming operation is performed for paper that has a comparatively long width dimension (A4 size paper, for example). That is, a fogged image is formed in the region corresponding to the difference in the width dimension of paper that has a comparatively long width dimension and paper that has a comparatively short width dimension.

As a method for eliminating the occurrence of this sort of fog phenomenon, image forming apparatuses have been proposed that perform the transfer process, not with a constant current control, but with a voltage control such that the transfer voltage is constant (for example, see JP 2002-49184A; hereafter referred to as "Patent Document 1"). Image forming apparatuses have also been proposed that reduce residual potential on the photosensitive body and make the transfer voltage constant, by de-electrifying the photosensitive body in an image forming apparatus that performs the transfer process with a constant current control (for example, see JP 2002-23576A; hereafter referred to as "Patent Document 2"). Further, it has also been proposed to avoid the generation of "fog" by decreasing the charging quantity of the photosensitive body in the non-image region below that of the image region as well as changing the development bias of the development unit (for example, see JP 2001-324843A; hereafter referred to as "Patent Document 3").

However, when making the transfer voltage constant by the methods disclosed in the Patent Document 1 and the Patent Document 2, there is much damage to the photosensitive body, inviting a deterioration in the lifetime of the photosensitive body. That is, with the image forming apparatus disclosed in the Patent Document 2, because de-electrification of the photosensitive body is performed with a de-electrifying voltage of opposite polarity to the charging properties of the photosensitive body, it is possible that this will lead to a deterioration in the lifetime of the photosensitive body. Also, with the image forming apparatus disclosed in the Patent Document 1, a change occurs in the resistance value of the printing paper due to changing the environment of the apparatus for constant voltage control, and a change in the optimum voltage occurs. The voltage to the photosensitive body changes, the photosensitive body is damaged, leading in this case as well to a deterioration in the lifetime of the photosensitive body. Also, there is the problem that when controlling the transfer process at a constant voltage, transfer efficiency decreases in comparison to controlling the transfer process at a constant current.

With the technology disclosed in the Patent Document 3, because it is necessary to vary the charging quantity of the photosensitive body between the non-image region and the image region, multiple electricity sources for conferring an electric potential that differs for each respective region and a switching mechanism are necessary, and because this leads to complication of the configuration, the technology lacks applicability.

Further, with the technology disclosed in any of the Patent Documents 1 to 3, because a state is maintained in which overcharged toner is always affixed on the development sleeve, it is not possible to eliminate overcharged toner that causes the generation of a fogged image. Thus, because it is possible that a fogged image will be generated and a worsening of image quality will be invited when even a slight change in the charging potential of the surface of the photosensitive body occurs, this technology is still inadequate to realize a highly reliable image forming apparatus that can always provide a high quality image.

DISCLOSURE OF INVENTION

The present invention was made in consideration of the circumstances described above, and it is an object thereof to provide a highly reliable image forming apparatus that can always provide a high quality image by periodically removing overcharged toner that is present on the development sleeve.

The image forming apparatus according to the present invention comprises a developer supply member (development sleeve) to whose surface developer (toner) can be affixed and an image carrier (photosensitive body) wherein, by developer being supplied from the developer supply member in a state in which an electrostatic latent image is formed on the surface, the electrostatic latent image is made as a development by this developer and a visible image is formed; wherein the image forming apparatus transfers the visible image formed on this image carrier to a recording medium and forms an image on the recording medium; and wherein the image forming apparatus further includes electrostatic latent image forming means that forms an "electrostatic latent image for removing developer" in a specified region of the image carrier surface corresponding to a region where developer is affixed that resides for more than a predetermined time period on the surface of the developer supply member, and wherein by forming this "electrostatic latent image for removing developer", a "developer renewal operation" is performed that supplies this developer that resides for more than a predetermined time period on the surface of the developer supply member to the image carrier surface.

As described above, in the region of the developer supply member (development sleeve) surface that corresponds to the region on the image carrier (photosensitive body) where the electrostatic latent image used for image formation on the recording medium (image forming electrostatic latent image) is formed, because the developer (toner) is consumed by the image carrier during the image forming operation, the developer on the developer supply member is periodically replaced, and the charging quantity of that toner does not rise too much. On the other hand, in regions other than the surface of the developer supply member, with the conventional technology, because developer was not consumed by the image carrier, this developer was not replaced and its charging quantity increased too much.

According to this image forming apparatus of the invention, an "electrostatic latent image for removing developer" is formed in a specified region of the image carrier surface corresponding to this region. Thus, a "developer renewal operation" is executed wherein developer that was not consumed by the image carrier in the conventional technology (developer that resided on the surface of the developer supply member) is supplied (removed) to the image carrier surface. Thus, overcharged developer is nearly eliminated from residing on the developer supply member for a long period of time, and it is possible to avoid fogged images generated because of this overcharged developer as much as possible. In this manner, with this solving means, it is possible to nearly eliminate overcharged developer that causes the generation of a fogged image, there is almost no generation of a fogged image even when there is a change in the charging potential of the surface of the image carrier, and it is possible to realize a highly reliable image forming apparatus that can always provide a high quality image.

The image forming apparatus according to the present invention may also adopt a configuration wherein the region in which the "electrostatic latent image for removing developer" is formed is a region other than the region where the recording medium passes the image carrier.

According to this image forming apparatus of the invention, when the recording medium is transported with a center standard, overcharged developer can be nearly eliminated from residing for a long time on both side portions of the developer supply member, and even if a shift occurs in the transport position of the recording medium, it is possible to avoid as much as possible a fogged image being generated by the overcharged developer on one edge of the recording medium, and an image with the desired high quality can be obtained.

The image forming apparatus according to the present invention may also adopt a configuration wherein the operation forming the "electrostatic latent image for removing developer" is performed at the same time as the operation forming the image forming electrostatic latent image that forms on the image carrier the electrostatic latent image used for forming an image on the recording medium.

According to this image forming apparatus of the invention, it is possible to perform the operation to remove residing developer that causes a fogged image at the same time as the operation forming the primary image (formation of a visible image with the image forming electrostatic latent image). That is, a special time period only for removing residing developer is not necessary. Thus, it is possible to nearly eliminate overcharged developer residing on the developer supply member for a long time period without decreasing the number of image forming sheets per unit time, and the generation of fogged images can be avoided as much as possible.

The image forming apparatus according to the present invention may also adopt a configuration wherein the operation forming the "electrostatic latent image for removing developer" is performed at a different time than the operation forming the image forming electrostatic latent image that forms the electrostatic latent image used for forming an image on the recording medium on the image carrier.

According to this image forming apparatus of the invention, the recording medium does not pass the image carrier during the "developer renewal operation" that is performed along with formation of this "electrostatic latent image for removing developer". Stated differently, when the operation forming the primary image (formation of a visible image with the image forming electrostatic latent image) is performed, the operation to remove residing developer (removal to the image carrier) is not performed. Thus, even in a state in which it is possible that a shift in the transport position of the recording medium will occur, because the residing developer is maintained on the developer supply member, there is almost no tainting of the recording medium by this residing developer, and it is possible to perform the primary image forming operation (formation of a visible image with the image forming electrostatic latent image) without any tainting of the recording medium.

The image forming apparatus according to the present invention may also adopt a configuration wherein the electrostatic latent image forming means forms the "electrostatic latent image for removing developer" on the image carrier surface and lets the "developer renewal operation" be performed during the successive image forming operation for multiple sheets of the recording medium.

According to this image forming apparatus of the invention, without the "developer renewal operation" being executed at a time that the user has not requested an image forming operation, it is possible to remove developer residing on the developer supply member without making the user aware of execution of this "developer renewal operation".

The image forming apparatus according to the present invention may also adopt a configuration wherein the electrostatic latent image forming means forms the "electrostatic latent image for removing developer" on the image carrier surface and lets the "developer renewal operation" be performed whenever the cumulative time of the image forming operation reaches a predetermined time.

According to this image forming apparatus of the invention, developer residing on the developer supply member can be surely removed on a periodic basis, an overcharged state of the developer affixed to the surface of the developer supply member can be nearly avoided, and generation of a fogged image can be prevented as much as possible.

The image forming apparatus according to the present invention may also adopt a configuration wherein the "electrostatic latent image for removing developer" formed on the image carrier by the electrostatic latent image forming means is formed as an image that supplies to the image carrier surface only a part of the developer that resides for more than a predetermined time period on the surface of the developer supply member.

The reason that an electrostatic latent image such that all of the residing developer is supplied to the image carrier surface is not formed is that, when forming the "electrostatic latent image for removing developer" in a region other than the passage region of the recording medium for the image carrier, by forming an "electrostatic latent image for removing developer" such that all of the residing developer is supplied to the image carrier surface, when a shift occurs in the transport position of the recording medium, a highly concentrated fogged image is formed in the edge portion of this recording medium, and image quality is greatly worsened. Also, mesh-shaped images and even low density (light black) images can be given as examples of the "electrostatic latent image for removing developer".

According to this image forming apparatus of the invention, because the "electrostatic latent image for removing developer" is formed such that only a part of the residing developer is supplied to the image carrier surface, even when a shift temporarily occurs in the transport position of the recording medium and a fogged image is formed, that fogged image is difficult to notice, and so a significant deterioration in image quality can be prevented.

The image forming apparatus according to the present invention may also adopt a configuration wherein the developer supply member is a development sleeve that is rotatively driven, the image carrier is close to this development sleeve and is a photosensitive drum that can rotate around an axis of rotation parallel to this development sleeve, and the length of the "electrostatic latent image for removing developer" formed on the photosensitive drum by the electrostatic latent image forming means in the circumferential direction of the photosensitive drum is set to be longer than the circumferential length of the development sleeve, and approximately equal to the circumferential length of this photosensitive drum.

According to this image forming apparatus of the invention, the entire periphery of the photosensitive drum is effectively used, and it is possible to remove developer residing on the surface of the development sleeve. For example, in the case that the peripheral length of the photosensitive drum is two times the peripheral length of the development sleeve, when the photosensitive drum is rotated one time, the development sleeve rotates two times, and it is possible to execute the "developer renewal operation" for the development sleeve two times in succession. Thus, as described above, even when an even low density (light black) image is formed, it is possible to surely remove a large portion of the residing developer by executing the "developer renewal operation" twice in succession.

The image forming apparatus according to the present invention may also adopt a configuration that includes a developer recovering means that recovers developer supplied to the image carrier surface by the "developer renewal operation".

Because it is possible that the developer recovered by the "developer renewal operation" will have a charging quantity that has risen too high, it is undesirable to reuse the recovered developer as image forming developer.

According to the image forming apparatus of this invention, that sort of developer is recovered by the developer recovery means and afterward discarded, and is not reused.

BRIEF DESCRIPTION OF DRAWINGS

FIG. 7(*b*) likewise shows the relationship between position and electrical current in the transfer roller.

FIG. 7(*c*) likewise shows the relationship between the position of the photosensitive drum and the surface electric potential of the photosensitive body.

BEST MODE FOR CARRYING OUT THE INVENTION

Hereinafter, the present invention will be described by way of illustrative embodiments with reference to the drawings. In the present embodiment, the present invention is described with regard to its application in a compound machine provided with a copy function, a print function, and a facsimile function.

—Explanation of the Overall Configuration of the Compound Machine—

Figure 1:
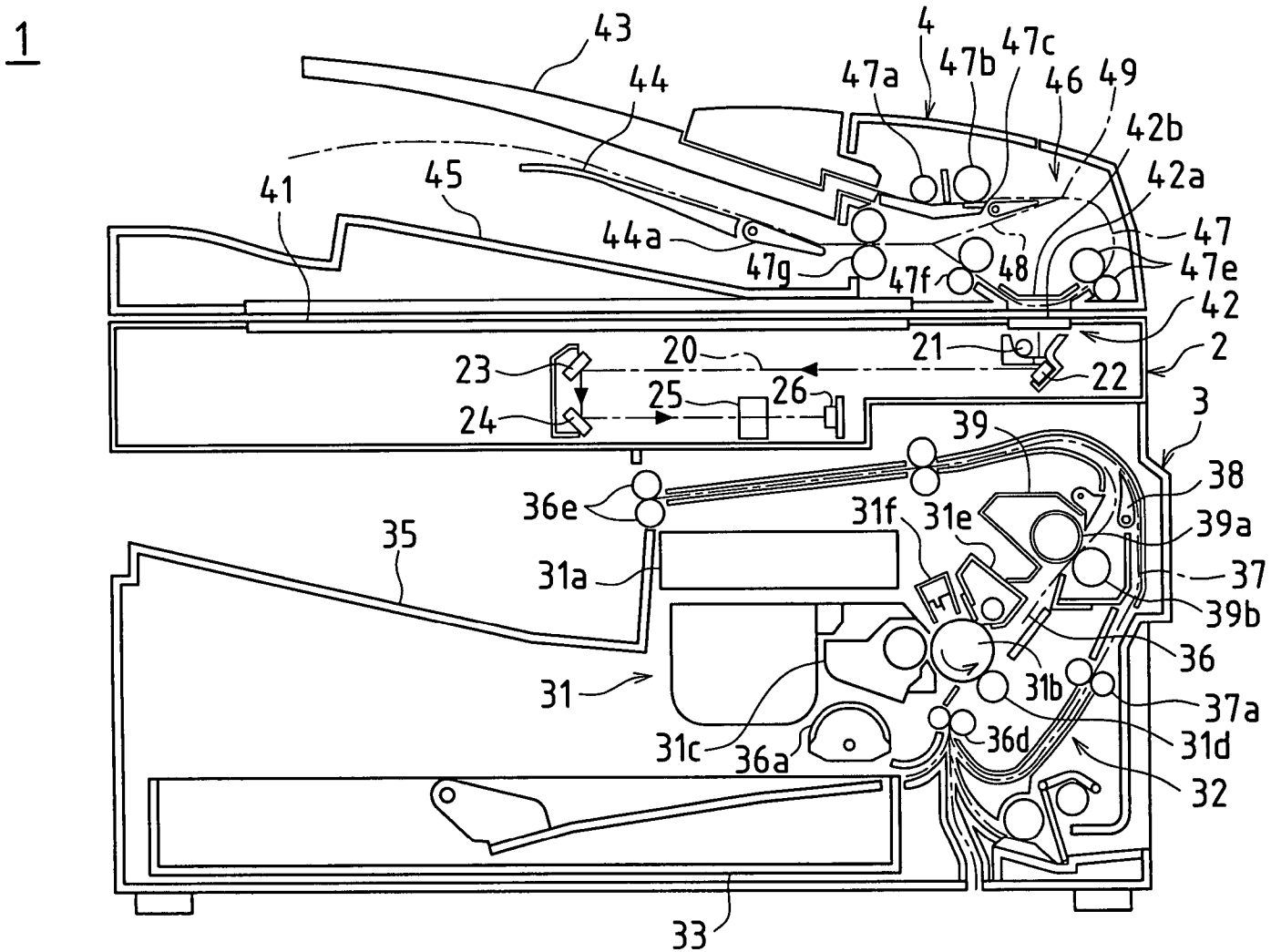
FIG. 1 is a drawing that schematically shows an internal structure of a compound machine according to an embodiment of the present invention.

FIG. 1 schematically shows an overview of the internal structure of a compound machine 1 as an image forming apparatus according to the present embodiment. As shown in FIG. 1, the compound machine 1 includes a scanner portion 2, a print portion 3 as an image forming portion, and an automatic original supply portion 4. These parts are described below.

<Description of The Scanner Portion 2>

The scanner portion 2 reads the image of an original placed on an original stage 41 that is made of transparent glass, or the like, or the image of an original that is supplied sheet by sheet from the automatic original supply portion 4, and creates image data. This scanner portion 2 includes an exposing light source 21, a plurality of reflecting mirrors 22, 23, and 24, an imaging lens 25, and a photoelectric transducer (CCD: Charge Coupled Device) 26.

The exposing light source 21 irradiates light onto the original placed on the original stage 41 of the automatic original supply portion 4 or the original carried by the automatic original supply portion 4. As indicated by an optical path 20, the reflecting mirrors 22, 23, and 24 are set so as to first reflect the light that is reflected from the original to the left of the diagram, after which they reflect the light downward, and after which they then reflect the light rightward toward the imaging lens 25.

As the operation to read the image of the original, if the original is placed on the original stage 41 (if used in the "stationary sheet mode"), then the exposing light source 21 and the reflecting mirrors 22, 23, and 24 horizontally scan the original stage 41 to read in the image of the entire original. On the other hand, if reading in an original that is carried by the automatic original supply portion 4 (if used in the "moving sheet mode"), the exposing light source 21 and the reflecting mirrors 22, 23, and 24 are fixed in the position shown in FIG. 1, and the image of the original is read in as the original passes an original capturing portion 42 of the automatic original supply portion 4, described later.

Light that is reflected by the reflecting mirrors 22, 23, and 24 to pass through the imaging lens 25 is guided to the photoelectric transducer 26, and the reflected light is converted into an electrical signal (original image data) by the photoelectric transducer 26.

<Description of The Print Portion 3>

The print portion 3 includes an image forming system 31 and a paper transport system 32.

The image forming system 31 includes a laser scanning unit 31*a* as electrostatic latent image forming means and a photosensitive drum 31*b* as a drum-type image carrier. The laser scanning unit 31*a* irradiates laser light onto the surface of the photosensitive drum 31*b*, based on the original image data that is converted by the photoelectric transducer 26. The photosensitive drum 31*b* rotates in the direction of the arrow shown in FIG. 1, and an electrostatic latent image is formed on its surface by laser light irradiated from the laser scanning unit 31*a*. The details of the electrostatic latent image formed by this laser scanning unit 31*a* ("image forming electrostatic latent image", "electrostatic latent image for removing developer") will be explained below.

In addition to the laser scanning unit 31*a*, a development apparatus (development mechanism) 31*c*, a transfer roller 31*d* that constitutes a transfer mechanism, a cleaning apparatus (cleaning mechanism) 31*e*, a de-electrifier not shown in the drawings, and a charging unit 31*f* are circumferentially arranged in order around the photosensitive drum 31*b*. The development apparatus 31*c* uses toner (developer constituting a substance for forming a manifest image) to develop the electrostatic latent image formed on the surface of the photosensitive drum 31*b* into a visible image. The transfer roller 31*d* transfers the toner image formed on the surface of the photosensitive drum 31*b* onto a piece of image forming paper as a recording medium. The cleaning apparatus 31*e* removes toner residing on the surface of the photosensitive drum 31*b* after toner transfer. The de-electrifier removes a residual electric charge from the surface of the photosensitive drum 31*b*. The charging unit 31*f* provides a predetermined electric potential to the surface of the photosensitive drum 31*b* before the electrostatic latent image is formed.

Thus, when forming an image on the image forming paper, the surface of the photosensitive drum 31*b* is charged to a predetermined electric potential by the charging unit 31*f*, and then the laser scanning unit 31*a* irradiates laser light onto the surface of the photosensitive drum 31*b* based on the original image data. After this, the development apparatus 31*c* uses toner to develop a visible image on the surface of the photosensitive drum 31*b*, and the toner image is transferred to image forming paper by the transfer roller 31*d*. Further still, after this, the cleaning apparatus 31*e* removes the toner residing on the surface of the photosensitive drum 31*b* and the de-electrifier removes the electric charge residing on the surface of the photosensitive drum 31*b*. Thus, one cycle of the operation to form an image on the image forming paper (printing operation) is complete. By repeating this cycle, it is possible to successively form images on a plurality of sheets of image forming paper.

On the other hand, the paper transport system 32 carries image forming paper contained in a paper cassette 33, which is a paper containing portion, sheet by sheet to form images according to the image forming system 31, and discharges the image forming paper on which an image has been formed to a discharge tray 35, which is a paper discharge portion.

The paper transport system 32 is provided with a main transport path 36 and a reverse transport path 37. The main transport path 36 faces the discharge side of the paper cassette 33, while the other end faces a discharge tray 35. One end of the reverse transport path 37 is connected to the main transport path 36 at upstream (below, in the drawing) of the arranged position of the transfer roller 31*d*, and the other end is connected to the main transport path 36 at downstream (above, in the drawing) of the arranged position of the transfer roller 31*d*.

The upstream end of the main transport path 36 (the part facing the discharge side of the paper cassette 33) is provided with a pickup roller 36*a* whose cross-section is semicircular. Image forming paper contained in the paper cassette 33 can be intermittently supplied sheet by sheet into the main transport path 36 by rotating the pickup roller 36*a*.

Registration rollers 36*d* are arranged in the main transport path 36 on the upstream side of the transfer roller 31*d*. The registration rollers 36*d* transport the image forming paper while matching the position of the toner image on the surface of the photosensitive drum 31*b* to the image forming paper. A fixing apparatus 39 including a hot roller 39*a* and a pressure roller 39*b* using heat to fix the toner image that is transferred to the image forming paper is arranged in the main transport path 36 on the downstream side of the position where the transfer roller 31*d* is arranged. Moreover, discharge rollers 36*e* for discharging the image forming paper to the discharge tray 35 are arranged at the downstream end of the main transport path 36.

A branch catch 38 is arranged at the position at which the upstream end of the reverse transport path 37 connects to the main transport path 36. The branch catch 38 is rotatable around a horizontal axis between a first position, which is shown by a solid line in FIG. 1, and, rotating in a counterclockwise direction in FIG. 1 from the first position, a second position opening the reverse transport path 37. When the branch catch 38 is in the first position, the image forming paper is carried toward the discharge tray 35, and when the branch catch 38 is in the second position, the image forming paper can be delivered into the reverse transport path 37. Transport rollers 37*a* are arranged in the reverse transport path 37, and if the image forming paper is delivered into the reverse transport path 37 (if the image forming paper is fed into the reverse transport path 37 by so-called "switchback transport"), then the image forming paper is transported by the transport rollers 37*a* and the image forming paper is reversed on the upstream side of the registration roller 36*d*, and is again carried along the main transport path 36 toward the transfer roller 31*d*. That is to say, it is handled such that an image may be formed on the back side of the image forming paper.

<Description of the Automatic Original Supply Portion 4>

The following is a description of the automatic original supply portion 4. The automatic original supply portion 4 is configured as a so-called automatic double-sided original transport apparatus. The automatic original supply portion 4 can be used for the moving sheet mode and is provided with an original tray 43 as an original placement portion, a middle tray 44, an original discharge tray 45 as an original discharge portion, and an original transport system 46 that transports originals between the trays 43, 44, and 45.

The original transport system 46 is provided with a main transport path 47 for transporting originals placed on the original tray 43 to the middle tray 44 or the original discharge tray 45 via the original capturing portion 42, and a sub transport path 48 for supplying originals on the middle tray 44 to the main transport path 47.

An original pickup roller 47*a* and a stacking roller 47*b* are arranged at an upstream end (a portion facing the discharge side of the original tray 43) of the main transport path 47. A stacking plate 47*c* is arranged below the stacking roller 47*b* and, due to the rotation of the original pickup roller 47*a*, one sheet of the originals on the original tray 43 passes between the stacking roller 47*b* and the stacking plate 47*c* such that it is supplied to the main transport path 47. PS rollers 47*e* are arranged on a side lower than a linking portion 49 between the main transport path 47 and the sub transport path 48. The PS rollers 47*e* regulate the leading edge of the original and the image reading timing of the scanner portion 2 when supplying originals to the original capturing portion 42. That is, the PS rollers 47*e* temporarily stop the transport of the original in the state in which the original was supplied, and regulate the image reading timing when supplying originals to the original capturing portion 42.

The original capturing portion 42 is provided with a glass platen 42*a* and an original pressing plate 42*b* and, when an original supplied from the PS rollers 47*e* passes through between the glass platen 42*a* and the original pressing plate 42*b*, light from the above-mentioned exposing light source 21 passes through the glass platen 42*a* and is irradiated on the original. At this time, original image data is obtained by the above-mentioned scanner portion 2. A biasing force is applied to the back surface (top surface) of the original pressing plate 42*b* by an unshown coil spring. In this way, the original pressing plate 42*b* makes contact against the glass platen 42*a* with a predetermined suppressing force, thus preventing the original from rising up from the glass platen 42*a* when the original passes through the original capturing portion 42.

Transport rollers 47*f* and original discharge rollers 47*g* are provided on a downstream side of the glass platen 42*a*. An original that passes over the glass platen 42*a* is discharged to the middle tray 44 or the original discharge tray 45 via the transport rollers 47*f* and the original discharge rollers 47*g*.

A middle tray swinging plate 44*a* is arranged between the original discharge rollers 47*g* and the middle tray 44. The middle tray swinging plate 44*a* has its swinging center at an edge portion of the middle tray 44 and is able to swing between a standard position shown in the drawing by a solid line and a raised position in which it is raised upwards from the standard position. When the middle tray swinging plate 44*a* is in this raised position, an original discharged from the original discharge rollers 47*g* is withdrawn to the original discharge tray 45. On the other hand, when the middle tray swinging plate 44*a* is in the standard position, an original discharged from the original discharge rollers 47*g* is discharged to the middle tray 44. When an original is discharged to the middle tray 44, an edge of the original is sandwiched between the original discharge rollers 47*g*, and by reversing the rotation of the original discharge rollers 47*g* while in this condition, the original is supplied to the sub transport path 48 and is again dispatched to the main transport path 47 via the sub transport path 48. The operation of reversing the rotation of the original discharge rollers 47*g* is carried out by regulating the dispatch of the original to the main transport path 47 and the timing of image reading. In this way, an image on the back side of an original can be read by the original capturing portion 42.

—Description of Basic Operation of the Compound Machine 1—

As the operation of the compound machine 1 configured as described above, first, this compound machine 1, when it functions as a printer, receives print data (image data or text data) sent from a host apparatus such as a personal computer, and stores this received print data in a buffer (memory) not shown. Along with storing this print data in the buffer, print data is read out from the buffer in sequence, and based on this read out print data, an image is formed on image forming paper by the image forming operation of the print portion 3 described above.

Also, when this compound machine 1 functions as a scanner, it stores the scan image data of the original read by the scanner portion 2 in the buffer. Along with storing this scan image data in the buffer, it sends the scan image data in sequence from the buffer to the host apparatus, and shows the image on a display of this host apparatus.

Further, when this compound machine 1 functions as a copy machine, an image is formed on image forming paper by the image forming operation of the print portion 3, based on the original image data read by the scanner function.

—Description of the Development Apparatus 31*c*—

Figure 2:
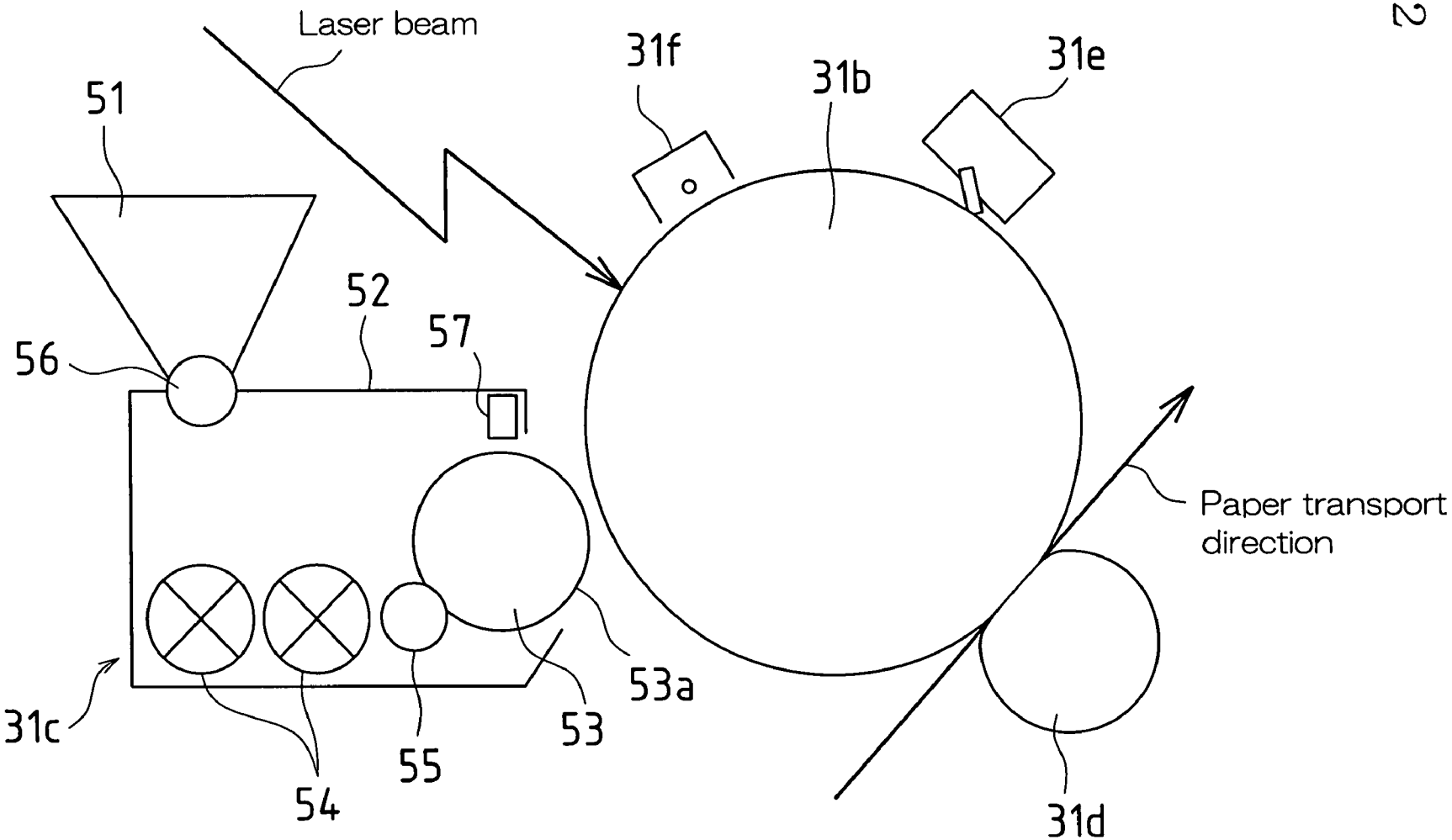
FIG. 2 is a drawing that shows the schematic structure of the development apparatus and its periphery.

The following is an explanation of the internal configuration of the development apparatus 31*c* provided in this compound machine 1. FIG. 2 is a schematic drawing that shows the configuration of the development apparatus 31*c* and its periphery. This development apparatus 31*c*, as explained above, develops and makes visible the electrostatic latent image formed on the photosensitive drum 31*b*.

This development apparatus 31*c* is provided with a toner box (toner cartridge) 51, which is a container that stores toner, and a development tank 52 filled with toner. A development roller 53 (with a development sleeve 53*a* made from metal formed in the outer peripheral portion), two agitating rollers 54, and a supply roller 55 are provided in the development tank 52.

Toner is stored in the toner box 51, and toner is resupplied to the development tank 52 as necessary. A toner resupply roller 56 is disposed in an opening portion of the bottom of this toner box 51, and toner in the toner box 51 is resupplied to the development tank 52 in the downward direction by the rotation of this toner resupply roller 56. The two agitating rollers 54 agitate and frictionally electrify the toner in the development tank 52. The supply roller 55 supplies this frictionally charged toner towards the outer peripheral surface of the development roller 53. This development roller 53 supplies toner to the photosensitive drum 31*b*.

In the development roller 53, a magnet roller, wherein multiple magnets (omitted from drawing) are fixed in order to generate a magnetic field, is inserted into the development sleeve 53*a*, which has a hollow cylindrical shape and is made of non-magnetic metal such as an aluminum alloy, brass, or SUS 304 stainless steel. While rotating the development sleeve 53*a*, this development roller 53 transports/supplies toner to the development portion that contacts the photosensitive drum 31*b* by magnetically attaching toner to the surface. Above this development roller 53, a doctor blade 57 is disposed at a small gap, and the thickness of the toner layer affixed to the surface of the development sleeve 53*a* can be set to a predetermined thickness by this doctor blade 57.

—Block Configuration of the Control System—

Figure 3:
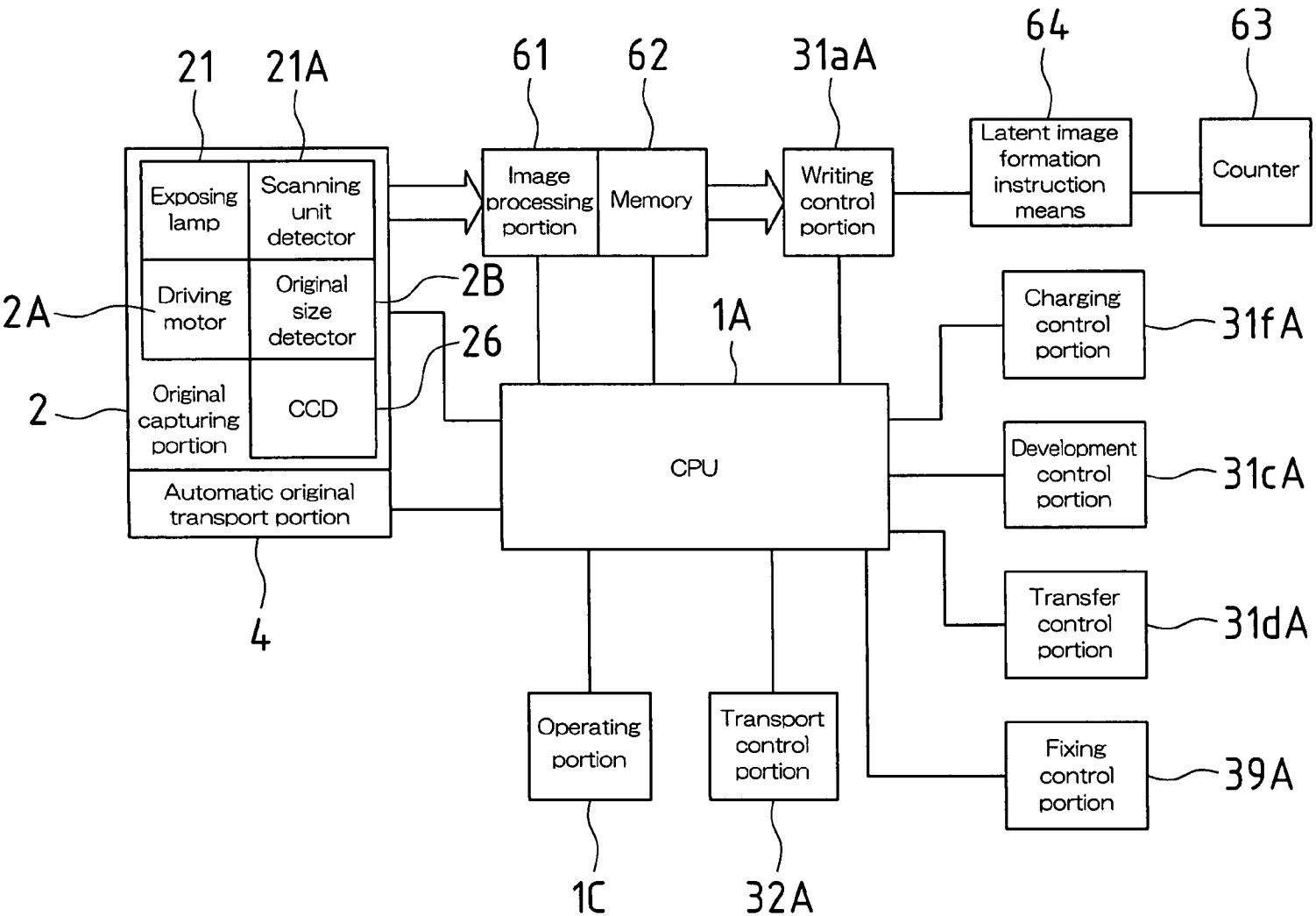
FIG. 3 is a block diagram that shows the control system of the compound machine.

FIG. 3 shows a block configuration of the control system of this compound machine 1. As shown in FIG. 3, the scanner portion 2 includes a driving motor 2A that is a driving source for scanning the exposing light source (exposing lamp) 21 and the reflecting mirrors 22, 23, and 24, a detector (scanning unit detector) 21A for detecting the scanning location of the exposing light source 21, and an original size detector 2B for detecting the size of the original placed on the original stage 41.

Also provided is a CPU 1A for performing integrated control of the devices included in this compound machine 1 (the scanner portion 2, the print portion 3, and the automatic original supply portion 4). In the block diagram of FIG. 3, "A" is attached to the numeral for each device as a control portion (controller) for controlling each device. A signal is sent to the CPU 1A from an unshown operating panel with which a user performs an input operation, and an operating portion 1C is also connected that causes a display operation to be performed on the operating panel in accordance with the signal from the CPU 1A.

The image processing portion 61 in FIG. 3 performs predetermined image processing of original data from the photoelectric transducer 26 and print data sent from the host apparatus. The image data that has been processed by this image processing portion 61 is temporarily stored in a memory 62, and afterwards it is sent to a writing control portion 31*a*A.

The distinguishing characteristic of this embodiment is that it is structured so that, for the electrostatic latent image formed on the photosensitive drum 31*b*, besides the operation forming the electrostatic latent image (image forming electrostatic latent image) used for forming the primary image, it is possible to form an electrostatic latent image (electrostatic latent image for removing developer) for removing toner that accumulates on the development sleeve 53*a* for a predetermined period of time (toner that may become overcharged, or toner that is already overcharged) on the photosensitive drum 31*b*. It is possible by forming this "electrostatic latent image for removing developer" to nearly eliminate the accumulation of overcharged toner on the development sleeve 53*a* for a long period of time.

Specifically, a counter 63 is provided that measures a cumulative rotation time of the development roller 53 by counting a cumulative number of rotations of the development roller 53, and a latent image formation instructing means 64 is provided that receives an output signal from this counter 63. When this latent image formation instructing means 64 receives an output signal from the counter 63 indicating that the cumulative number of rotations of the development roller 53 has reached a predetermined number of rotations (for example, 30 rotations), it instructs the writing control portion 31*a*A that controls the laser scanning unit 31*a* to execute an operation to form the "electrostatic latent image for removing developer". That is, it is configured so that whenever the cumulative number of rotations of the development roller 53 measured by the counter 63 reaches a predetermined number of rotations, an operation is executed by the laser scanning unit 31*a* to form an "electrostatic latent image for removing developer". The cumulative number of rotations of the development roller 53 that determines the time at which to execute the operation of forming the "electrostatic latent image for removing developer" is not restricted to the number of rotations described above and can be discretionarily set.

Figure 4:
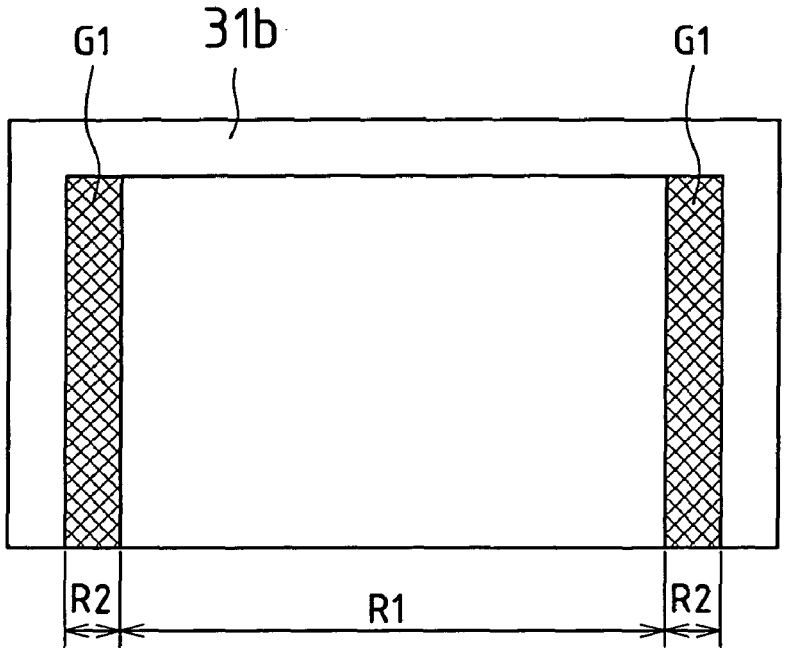
FIG. 4 is a drawing that shows the formation pattern of the "electrostatic latent image for removing developer".
Figure 5:
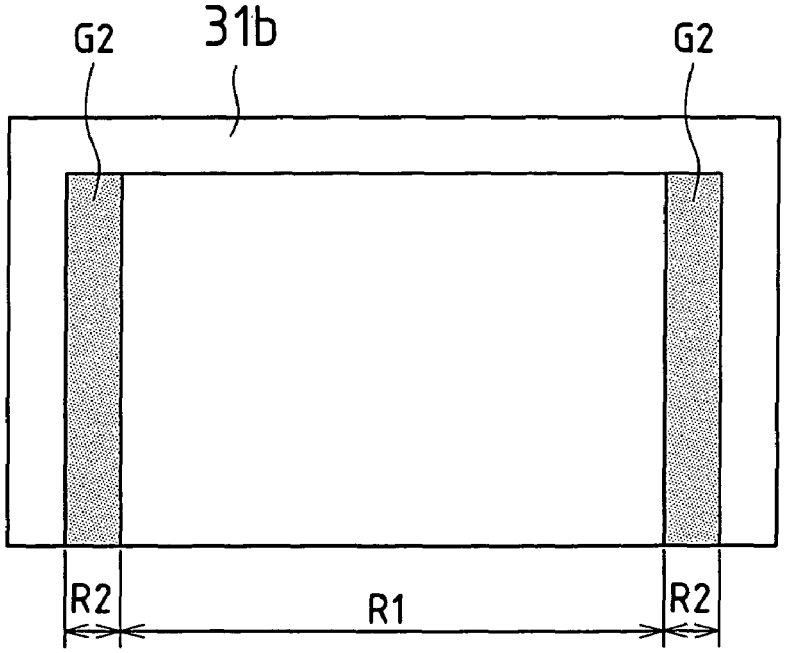
FIG. 5 is a drawing that shows the formation pattern of other than the "electrostatic latent image for removing developer".

Following is an explanation of the "electrostatic latent image for removing developer". FIG. 4 and FIG. 5 show the formation region (formation location) and formation pattern when the "electrostatic latent image for removing developer" is formed on the photosensitive drum 31*b*, and show a state in which toner is affixed to this "electrostatic latent image for removing developer".

As shown in these drawings, the "electrostatic latent image for removing developer" is formed in the non-paper passage region R2 on the photosensitive drum 31*b* (the region other than the passage region R1 of the recording paper). As formation patterns of the "electrostatic latent image for removing developer", a mesh-shaped image G1 as shown in FIG. 4 and a low density uniform (light black) image G2 as shown in FIG. 5 can be given as examples. Further, the formation range of the "electrostatic latent image for removing developer" is set approximately equal to the circumference of the photosensitive drum 31*b*.

In the present invention, during successive image forming operations for multiple sheets of recording paper, the "electrostatic latent image for removing developer" is formed on the photosensitive drum 31*b* at the point in time that the cumulative number of rotations of the development roller 53 reaches a predetermined number of rotations. The operation forming this "electrostatic latent image for removing developer" is performed at the same time as the operation forming the primary electrostatic latent image (image forming electrostatic latent image) used to form an image on the recording paper. That is, at the point in time that the cumulative number of rotations of the development roller 53 reaches a predetermined number of rotations, along with an "image forming electrostatic latent image" being formed for the recording paper passage region R1 on the photosensitive drum 31*b*, an "electrostatic latent image for removing developer" is formed in the non-paper passage region R2 on the photosensitive drum 31*b*, forming an electrostatic latent image on approximately the entire surface of the photosensitive drum 31*b*.

—Description of the Image Forming Operation—

Figure 6:
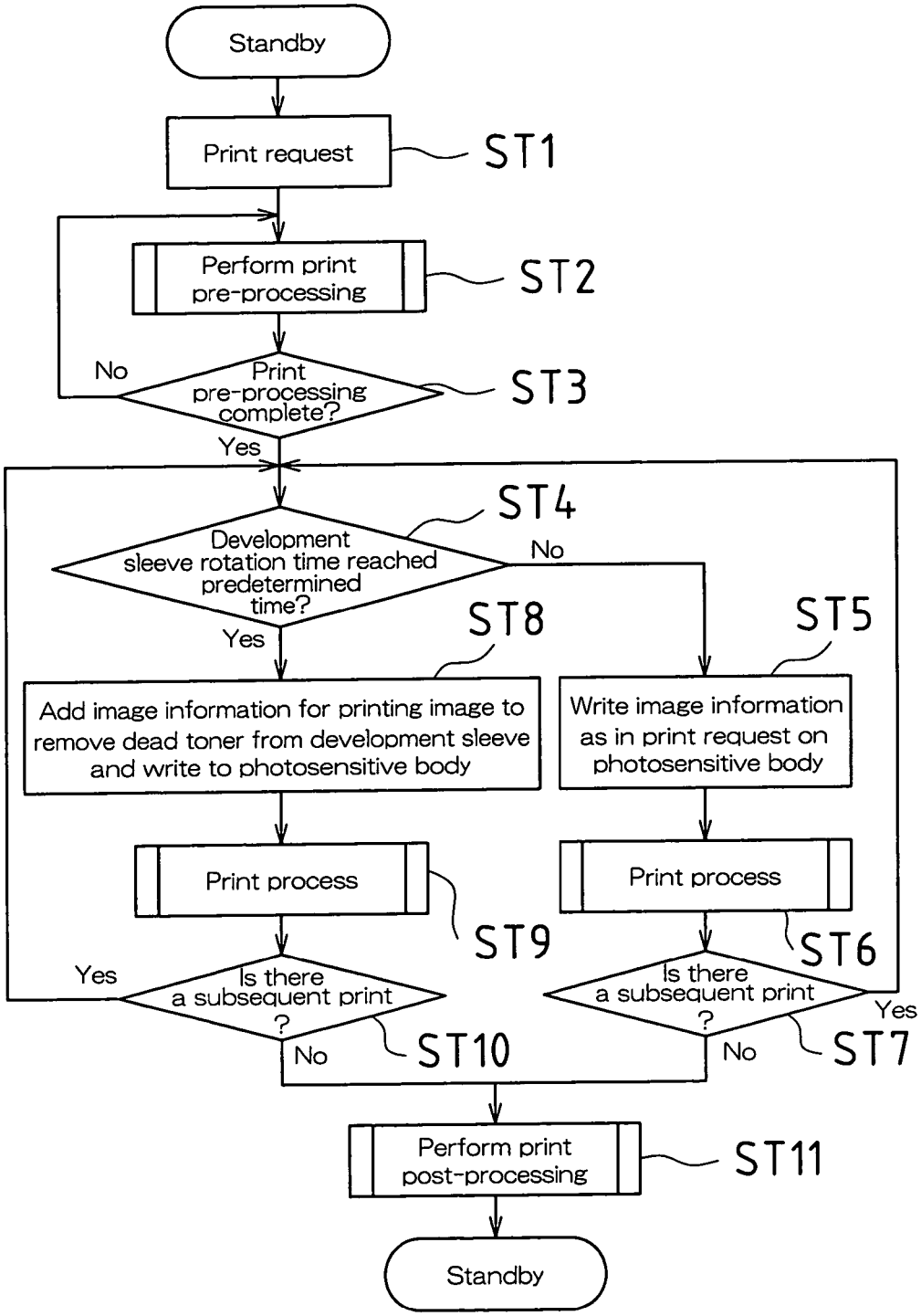
FIG. 6 is a flowchart that illustrates the image forming operation.
Figure 7:
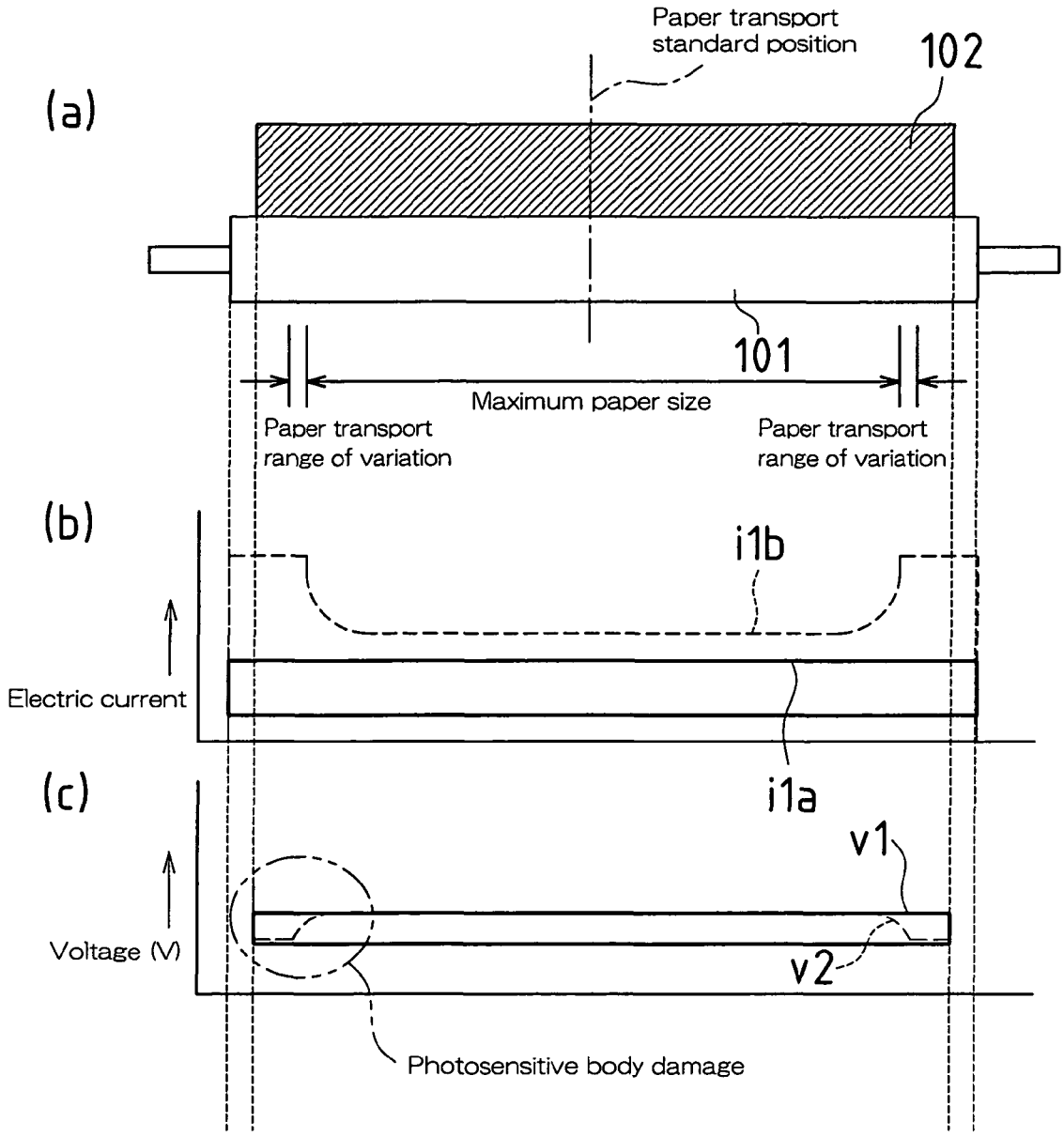
FIG. 7(*a*) is drawing that illustrates the change in the electric current of the transfer roller and the surface electric potential of the photosensitive drum in the transfer process of a conventional example, and shows the positional relationship between the transfer roller and the photosensitive drum.
Figure 8:
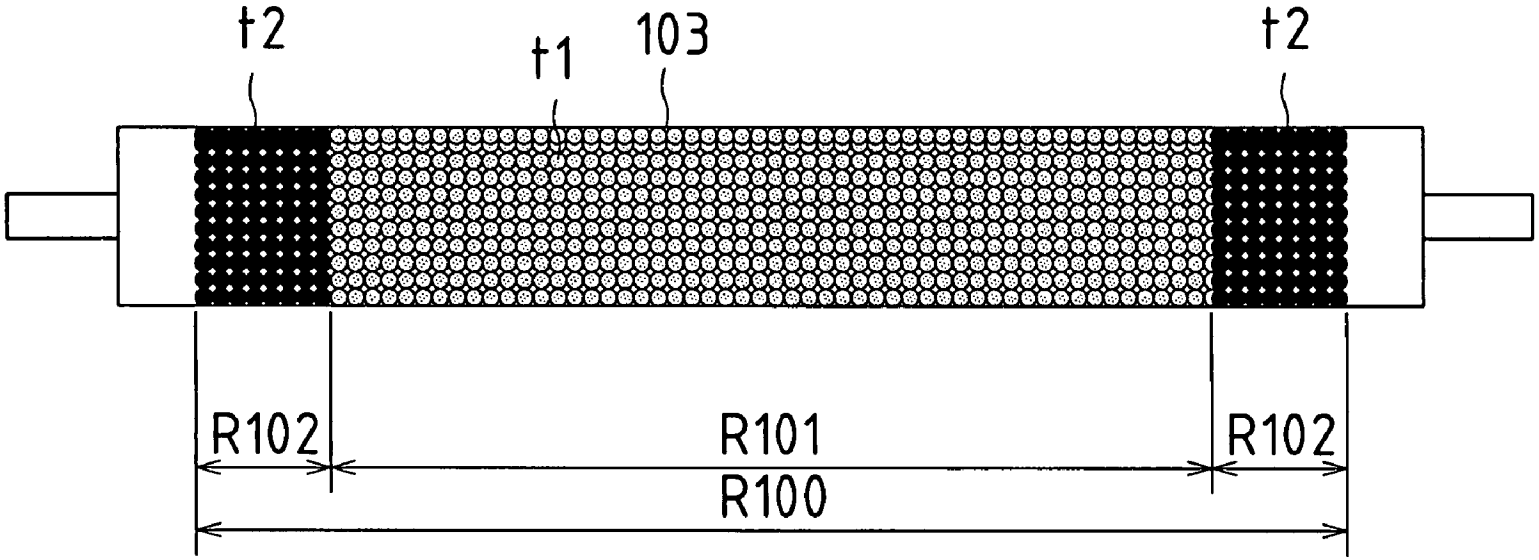
FIG. 8 is a drawing that illustrates the affixed state of toner on the development sleeve and the toner charging quantity.
Figure 9:
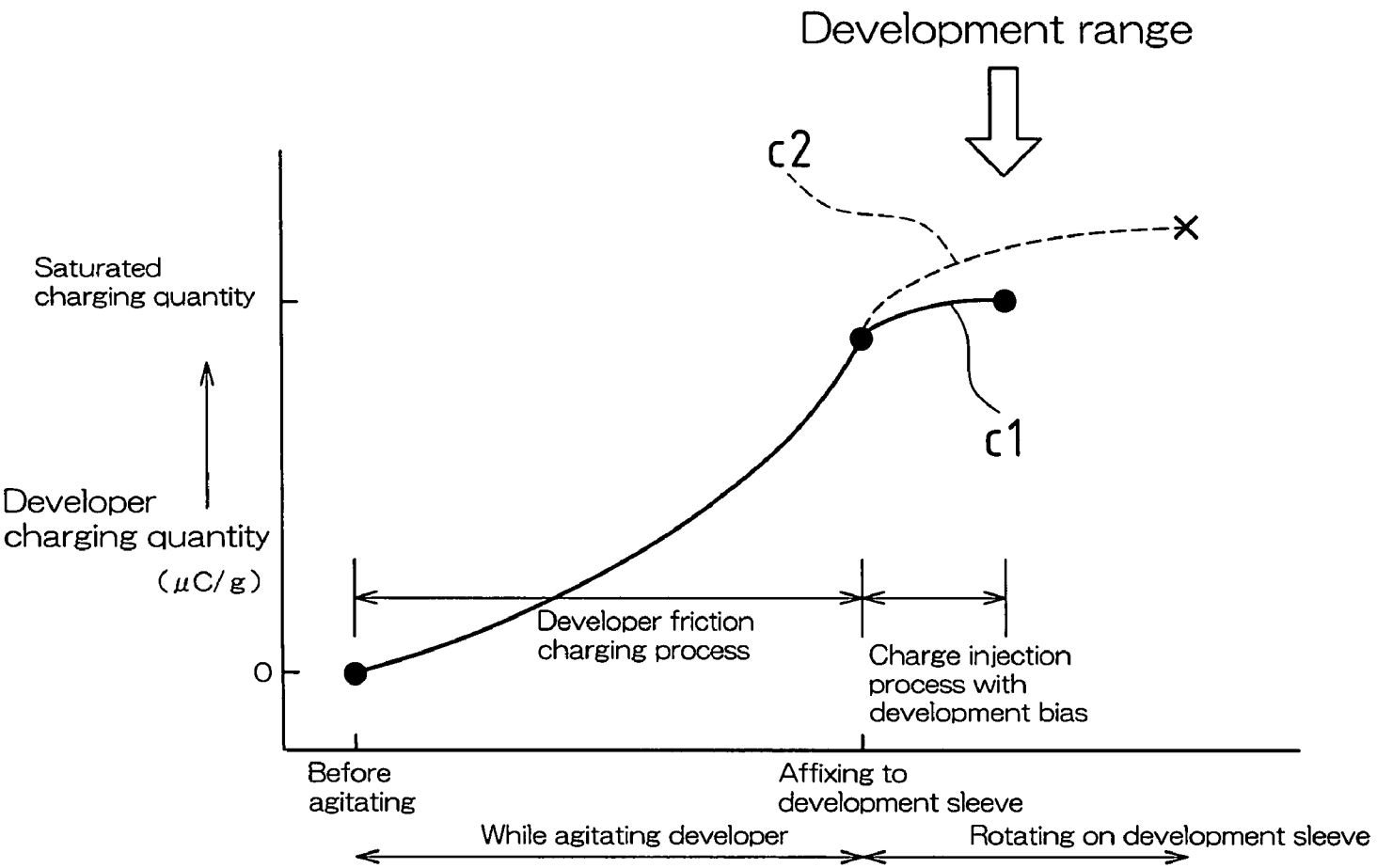
FIG. 9 is a drawing that illustrates the change in charging quantity of the developer affixed to the development sleeve in a conventional example.

Following is a description of the image forming operation in the present embodiment, with reference to the flow chart of FIG. 6. First, in Step ST1, when a print request (image forming request) is made by a user, the operation moves to Step ST2 and executes print pre-processing. Here, print pre-processing refers to an initialization process of the photosensitive drum 31*b*, a toner pre-charging process (pre-agitating by the agitating rollers 54), a temperature control operation of the hot roller 39*a* provided in the fixing apparatus 39, and the like.

In Step ST3, when the print pre-processing is judged to be complete ("Yes" judgment), the operation moves to Step ST4, and it is judged whether or not the cumulative rotation time of the development sleeve 53*a* (calculated by the cumulative number of rotations) measured by the counter has reached a predetermined period of time.

At this point, when the cumulative rotation time of the development sleeve 53*a* has not reached a predetermined number of rotations and "No" is judged, in Step ST5, an electrostatic latent image (image forming electrostatic latent image) is written on the photosensitive drum 31*b* based only on the image information that is demanded for image formation. That is, the "electrostatic latent image for removing developer" is not formed, and only formation of the "image forming electrostatic latent image" used for forming the primary image is executed. Afterward, in Step ST6, print processing (image formation processing) is executed for the recording paper by executing the image transfer operation to the recording paper in the print portion 3 and the image fixing operation in the fixing apparatus 39.

After execution of this print processing, it is judged whether or not there is image information for subsequent printing, and the operation described above is repeated until the cumulative rotation time of the development sleeve 53*a* reaches a predetermined time or until there is no image information for subsequent printing.

On the other hand, in Step ST4, when the cumulative rotation time of the development sleeve 53*a* has reached a predetermined time and "Yes" is judged, the operation moves to Step ST8. In this Step ST8, the formation of an "electrostatic latent image for removing developer" is executed at the same time as formation of an electrostatic latent image used for forming the primary image (image forming electrostatic latent image). That is, at the same time that an "image forming electrostatic latent image" is formed in the recording paper passage region R1 (see FIG. 4) on the photosensitive drum 31*b*, an "electrostatic latent image for removing developer" is formed in the non-paper passage region R2 (see FIG. 4) on the photosensitive drum 31*b*.

After formation of each electrostatic latent image in this manner, in Step ST9, the image transfer operation to the recording paper in the print portion 3 and the image fixing operation in the fixing apparatus 39 are performed, executing print processing (an image forming operation) on the recording paper. At this point toner is also supplied from the development sleeve 53*a* onto the photosensitive drum 31*b* for the non-paper passage region R2 (the region other than the recording paper passage region R1 of the recording paper) where the "electrostatic latent image for removing developer" is formed. Accordingly, the toner on the development sleeve 53*a* that corresponds to this non-paper passage region R2 is removed to the photosensitive drum 31*b* (execution of a "developer renewal operation"), overcharged toner is substantially kept from residing on the development sleeve 53*a* for a long period of time, and it is possible to avoid fogged images generated because of this overcharged toner to the extent possible. Because the recording paper does not pass the region that overcharged toner is affixed on the photosensitive drum 31*b*, the recording paper is not tainted by this overcharged toner.

The overcharged toner affixed on the photosensitive drum 31*b* by the "developer renewal operation" is recovered and removed with the cleaning apparatus 31*e* by rotation of the photosensitive drum 31*b*. Because the charging quantity of the toner recovered by this cleaning apparatus 31*e* (scraped off by a cleaning blade) may rise too much, it is undesirable to reuse this recovered toner as image forming developer. Accordingly, this toner is afterwards discarded.

After execution of this print processing, it is judged whether or not there is image information for subsequent printing, and when there is image information for subsequent printing the operation returns to Step ST4 and repeats the operation described above. That is, until there is no image information for subsequent printing, whenever the cumulative rotation time of the development sleeve 53*a* reaches a predetermined time, the "developer renewal operation" is performed by forming an "electrostatic latent image for removing developer". When there is no image information for subsequent printing, the operation moves to Step ST11 and performs print post-processing, and then moves to a "standby state" waiting for the next print request.

Effect of Embodiment

As explained above, with the present embodiment, for an electrostatic latent image formed on the photosensitive drum 31*b*, besides the operation forming an "image forming electrostatic latent image" used for primary image forming, by periodically executing an operation forming an "electrostatic latent image for removing developer" in order to remove toner from the photosensitive drum 31*b* that resides on the development sleeve 53*a* for a predetermined period of time, overcharged toner is substantially kept from residing on this development sleeve 53*a* for a long period of time. Thus, it becomes possible to nearly eliminate overcharged toner that causes a fogged image, and even when a change in the charging potential of the surface of the photosensitive drum 31*b* occurs, there is almost no generation of a fogged image, and it is possible to realize a highly reliable compound machine 1 that can always provide a high quality image.

Also, with the present embodiment, the operation forming the "electrostatic latent image for removing developer" is performed at the same time as the operation forming the "image forming electrostatic latent image". That is, a special period of time used only to remove toner residing on the development sleeve 53*a* is not necessary. Thus, it is possible to nearly eliminate overcharged toner residing on the development sleeve 53*a* for a long time period without decreasing the number of image forming sheets per unit time, and the generation of fogged images can be avoided to the extent possible.

Further, with the present embodiment, a "developer renewal operation" is executed during successive image forming operations for multiple sheets of recording paper. Thus, without the "developer renewal operation" being executed at a time that the user has not requested an image forming operation, it is possible to remove developer residing on the developer supply member without making the user aware of execution of this "developer renewal operation".

In addition, in the present embodiment, as the "electrostatic latent image for removing developer", patterns forming a low density (light black) image and patterns forming a mesh-shaped image are used. That is, a pattern is not used that forms an electrostatic latent image such that all of the residing toner is supplied to the surface of the photosensitive drum 31*b*. Thus, even if a shift temporarily occurs in the transport position of the recording paper and a fogged image is generated by overcharged toner, that fogged image is difficult to notice, and image quality does not significantly deteriorate.

Modified Embodiment

In the embodiment described above, formation of the "electrostatic latent image for removing developer" was executed at the same time as forming the electrostatic latent image used to form the primary image (image forming electrostatic latent image). As a substitute for this, in the present modified embodiment, the operation forming the "electrostatic latent image for removing developer" is performed at a different time than the formation of the "image forming electrostatic latent image". That is, when the "developer renewal operation" is performed during the execution of the image forming operation (when the cumulative rotation time of the development sleeve 53*a* has reached a predetermined time), in a state in which formation of the "image forming electrostatic latent image" is halted, only formation of the "electrostatic latent image for removing developer" is performed. After the "developer renewal operation" is executed by forming only this "electrostatic latent image for removing developer", formation of the "image forming electrostatic latent image" is resumed, returning to an ordinary image forming operation.

This operation forming the "electrostatic latent image for removing developer" may also be performed immediately before starting or immediately after completing the image forming operation.

When performing the "developer renewal operation" in this manner, when the primary image forming operation (formation of a visible image by the image forming electrostatic latent image) is performed, the operation removing residing developer is not performed. Thus, even if temporarily in a state in which a shift can occur in the transport position of the recording paper, there is almost no tainting of the recording paper by this residing toner, and it is possible to perform the image forming operation of the primary image (forming of a visible image by the image forming electrostatic latent image) without tainting the recording paper.

Other Embodiments

In the embodiments described above, the present invention was described with respect to its application in the multifunction image forming apparatus 1 provided with functions as a copying machine, printer apparatus, and facsimile apparatus. The present invention is not restricted to this apparatus, and can also be applied in other image forming apparatuses.

The present invention can also be applied to an image forming apparatus provided with a development apparatus with a dry two-component magnetic brush development system that uses developer in which toner and carrier are mixed.

Further, in the embodiment described above, the non-paper passage region R2 (see FIG. 4: region other than the recording paper passage region R1) was the formation region of the "electrostatic latent image for removing developer". The present invention is not restricted to this configuration; the "electrostatic latent image for removing developer" may also be formed in the recording paper passage region R1 (see FIG. 4). Specifically, for example, when successively performing image formation on multiple sheets of recording paper, when a state continues wherein an image is not present in the central portion and both edge portions in the width direction of that recording paper, toner is not substituted in the region on the development sleeve 53*a* that faces the central portion and both edge portions, and there is a possibility that its charging quantity will rise too much. Thus, in order to avoid as much as possible an overcharged state due to supplying this toner onto the photosensitive drum 31*b*, the "electrostatic latent image for removing developer" is formed in a part (region facing the central portion and both edge portions) of the recording paper passage region R1. It is necessary that the timing for formation of the "electrostatic latent image for removing developer" in this case is different from the timing for formation of the "image forming electrostatic latent image", as in the modified embodiment described above.

The present invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes that come within the meaning and range of equivalency of the claims are intended to be embraced therein.

This application claims priority on Patent Application No. 2003-140664 filed in Japan on May 19, 2003, the entire contents of which are hereby incorporated by reference. Patents and publications cited herein are hereby incorporated by reference in entirety.

INDUSTRIAL APPLICABILITY

In the above manner, the present invention is extremely advantageous for electrophotographic image forming apparatuses such as laser printers, digital copy machines, compound machines, and the like.

The invention claimed is:

1. An image forming apparatus comprising:

a developer supply member to whose surface developer can be affixed; and an image carrier wherein, by the developer being supplied from the developer supply member in a state in which an electrostatic latent image is formed on the surface, the electrostatic latent image is made as a development by this developer and a visible image is formed, wherein the image forming apparatus transfers the visible image formed on this image carrier to a recording medium and forms an image on the recording medium, and the image forming apparatus further comprises electrostatic latent image forming means that forms an electrostatic latent image for removing developer in a specified region of the image carrier surface corresponding to a region where developer is affixed that resides for more than a predetermined time period on the surface of the developer supply member, and wherein by forming the electrostatic latent image for removing developer, a developer renewal operation is performed that supplies the developer that resides for more than a predetermined time period on the surface of the developer supply member to the image carrier surface, wherein the region in which the electrostatic latent image for removing developer is formed is a non-paper passage region other than the region where the recording medium passes the image carrier; and wherein the electrostatic latent image for removing developer formed on the image carrier by the electrostatic latent image forming means is formed as a low density an-image that supplies to the image carrier surface only a part of the developer that resides for more than a predetermined time period on the surface of the developer supply member so that the developer is replaced and eliminated in the region on the surface of the developer supply member that corresponds to the non-paper passage region.

2. The image forming apparatus according to claim 1, wherein the operation forming the electrostatic latent image for removing developer is performed at the same time as the operation forming the image forming electrostatic latent image that forms on the image carrier the electrostatic latent image used for forming an image on the recording medium.

3. The image forming apparatus according to claim 1, wherein the operation forming the electrostatic latent image for removing developer is performed at a different time than the operation forming the image forming electrostatic latent image that forms on the image carrier the electrostatic latent image used for forming an image on the recording medium.

4. The image forming apparatus according to claim 1, wherein the electrostatic latent image forming means forms the electrostatic latent image for removing developer on the image carrier surface and allows the developer renewal operation be performed, during the successive image forming operation for a plurality of sheets of the recording medium.

5. The image forming apparatus according to claim 1, wherein the electrostatic latent image forming means forms the electrostatic latent image for removing developer on the image carrier surface and allows the developer renewal operation be performed whenever the cumulative time of the image forming operation reaches a predetermined time.

6. The image forming apparatus according to claim 1, wherein the developer supply member is a development sleeve that is rotatively driven, and the image carrier is close to this development sleeve and is a photosensitive drum that can rotate around an axis of rotation parallel to this development sleeve, and the length of the electrostatic latent image for removing developer formed on the photosensitive drum by the electrostatic latent image forming means in the circumferential direction of the photosensitive drum is set to be longer than the circumferential length of the development sleeve, and approximately equal to the circumferential length of this photosensitive drum.

7. The image forming apparatus according to claim 1, further comprising:

a developer recovering means that recovers developer supplied to the image carrier surface by the developer renewal operation.

8. The image forming apparatus according to claim 2, wherein the electrostatic latent image forming means forms the electrostatic latent image for removing developer on the image carrier surface and allows the developer renewal operation be performed, during the successive image forming operation for a plurality of sheets of the recording medium.

9. The image forming apparatus according to claim 3, wherein the electrostatic latent image forming means forms the electrostatic latent image for removing developer on the image carrier surface and allows the developer renewal operation be performed, during the successive image forming operation for a plurality of sheets of the recording medium.

10. The image forming apparatus according to claim 2, wherein the electrostatic latent image forming means forms the electrostatic latent image for removing developer on the image carrier surface and allows the developer renewal operation be performed whenever the cumulative time of the image forming operation reaches a predetermined time.

11. The image forming apparatus according to claim 3, wherein the electrostatic latent image forming means forms the electrostatic latent image for removing developer on the image carrier surface and allows the developer renewal operation be performed whenever the cumulative time of the image forming operation reaches a predetermined time.

12. The image forming apparatus according to claim 2, wherein the developer supply member is a development sleeve that is rotatively driven, and the image carrier is close to this development sleeve and is a photosensitive drum that can rotate around an axis of rotation parallel to this development sleeve, and the length of the electrostatic latent image for removing developer formed on the photosensitive drum by the electrostatic latent image forming means in the circumferential direction of the photosensitive drum is set to be longer than the circumferential length of the development sleeve, and approximately equal to the circumferential length of this photosensitive drum.

13. The image forming apparatus according to claim 3, wherein the developer supply member is a development sleeve that is rotatively driven, and the image carrier is close to this development sleeve and is a photosensitive drum that can rotate around an axis of rotation parallel to this development sleeve, and the length of the electrostatic latent image for removing developer formed on the photosensitive drum by the electrostatic latent image forming means in the circumferential direction of the photosensitive drum is set to be longer than the circumferential length of the development sleeve, and approximately equal to the circumferential length of this photosensitive drum.

14. The image forming apparatus according to claim 1, wherein the developer supply member includes a development sleeve rotatably provided adjacent the image carrier, and the predetermined time period is determined based on a number of rotations of the development sleeve.

15. The image forming apparatus according to claim 1, wherein the electrostatic latent image for removing developer has a meshed shape.

16. The image forming apparatus according to claim 1, wherein the electrostatic latent image for removing developer is a low density uniform image.

* * * * *